US009583283B2

(12) United States Patent
Connell

(10) Patent No.: US 9,583,283 B2
(45) Date of Patent: Feb. 28, 2017

(54) ELECTRICAL CONTACTOR WITH MOVABLE ARM

(71) Applicant: Johnson Electric S.A., Murten (CH)

(72) Inventor: Richard Anthony Connell, Cambridge (GB)

(73) Assignee: JOHNSON ELECTRIC S.A., Murten (CH)

( * ) Notice: Subject to any disclaimer, the term of this patent is extended or adjusted under 35 U.S.C. 154(b) by 0 days.

(21) Appl. No.: 14/554,352

(22) Filed: Nov. 26, 2014

(65) Prior Publication Data

US 2015/0145619 A1 May 28, 2015

(30) Foreign Application Priority Data

Nov. 26, 2013 (GB) ..... 1320863.2

(51) Int. Cl.

| | |
|---|---|
| ***H01H 7/16*** | (2006.01) |
| ***H01H 47/18*** | (2006.01) |
| *H01H 47/22* | (2006.01) |
| *H01H 50/24* | (2006.01) |
| *H01H 50/44* | (2006.01) |
| *H01H 50/64* | (2006.01) |
| *H01H 51/22* | (2006.01) |

(52) U.S. Cl.

CPC ..... *H01H 7/16* (2013.01); *H01H 47/18* (2013.01); *H01H 47/226* (2013.01); *H01H 50/24* (2013.01); *H01H 50/44* (2013.01); *H01H 50/642* (2013.01); *H01H 51/2227* (2013.01); *H01H 51/2272* (2013.01)

(58) Field of Classification Search

CPC ..... H01H 47/18; H01H 7/16; H01H 47/226; H01H 51/2272; H01H 50/44; H01H 50/642; H01H 51/2227; H01H 50/24

See application file for complete search history.

(56) References Cited

U.S. PATENT DOCUMENTS

| | | | | |
|---|---|---|---|---|
| 3,188,527 | A | 6/1965 | Luce | |
| 5,583,471 | A | 12/1996 | Weiser et al. | |
| 6,292,075 | B1 * | 9/2001 | Connell et al. | 335/185 |
| 6,788,176 | B2 * | 9/2004 | Schmelz | 335/80 |

FOREIGN PATENT DOCUMENTS

| | | |
|---|---|---|
| GB | 2249892 | 5/1992 |
| GB | 2299896 | 10/1996 |
| GB | 2374218 | 10/2002 |
| GB | 2418780 | 4/2006 |

OTHER PUBLICATIONS

Search Report dated Jun. 29, 2015 issued in counterpart European patent application No. 14194898 (1 page).

* cited by examiner

*Primary Examiner* — Bernard Rojas

(74) *Attorney, Agent, or Firm* — Muncy, Geissler, Olds & Lowe, P.C.

(57) ABSTRACT

An electrical contactor has a first terminal having a fixed member with at least one fixed electrical contact, a second terminal, and at least one movable electrical contact in electrical communication with the second terminal. A dual-coil actuator is also provided and has a first drive coil drivable to open and close the movable and fixed electrical contacts, and a second non-drive coil feedback connected to induce a reverse flux to temper and stabilize a net flux. Control of a delay time of the opening and closing electrical contacts is thus possible, so as to be at or adjacent to a subsequent or next zero-crossing of an associated AC load current waveform.

1 Claim, 6 Drawing Sheets

ELECTRICAL CONTACTOR WITH MOVABLE ARM

CROSS REFERENCE TO RELATED APPLICATIONS

This non-provisional patent application claims priority under 35 U.S.C. §119(a) from Patent Application No. GB1320863.2 filed in The United Kingdom on Nov. 26, 2013, the entire contents of which are hereby incorporated by reference.

FIELD OF THE INVENTION

The present invention relates to an electrical contactor, particularly but not necessarily exclusively for moderate DC coil-drive switching contactors employed in modem electricity meters, so-called 'smart meters', for performing a load-disconnect function at normal domestic supply mains voltages, typically being 100 V AC to 250 V AC.

BACKGROUND OF THE INVENTION

The invention may also relate to an electrical contactor of a moderate, preferably direct, current switch which may be subjected to a short-circuit fault condition requiring the contacts to not weld. In this welded-contact fault condition, un-metered electricity is supplied. This can lead to a life-threatening electrical shock hazard, if the load connection that is thought to be disconnected is still live at 230 V AC.

The term 'moderate' is intended to mean less than or equal to 120 Amps.

Furthermore, it is a requirement that the opening and closing timing of the electrical contacts in such a moderate-current switch should be more precisely controlled to reduce or prevent arcing damage thereby increasing their operational life.

It is known that many electrical contactors are capable of switching nominal current at, for example, 100 Amps, for a large number of switching load cycles. The switch contacts utilize a suitable silver-alloy which aims to prevent tack-welding but not necessarily arcing. The switch arm carrying the movable contact must be configured to be easily actuated for the disconnect function, with minimal self-heating at the nominal currents concerned.

The non-weld UC (Utilisation Category) levels demanded are also very challenging, irrespective of whether the switch is closing into or carrying the short-circuit currents. In most cases, the very high current-density during a short-circuit condition at the single-contact touch-point can easily create tack-welds.

It is also known that, to reduce the heating effects of high current, the single movable arm may be split into two. However, this does not overcome the problem associated with simultaneous driving of the arms or blades to open and close together. This can lead to serious imbalances within the contact set and actuator, resulting in shock, vibration and increased contact bounce.

The present invention seeks to provide solutions to these problems.

SUMMARY OF THE INVENTION

According to a first aspect of the invention, there is provided an electrical contactor comprising a first terminal having a fixed member with at least one fixed electrical contact; a second terminal; at least one movable electrical contact in electrical communication with the second terminal; and dual-coil actuator having a first drive coil drivable to open and close the movable and fixed electrical contacts, and a second non-drive coil feedback connected to induce a reverse flux to temper and stabilize a net flux, thereby enabling control of a delay time of the opening and closing electrical contacts so as to be at or adjacent to a zero-crossing of an associated AC load current waveform.

The control of the opening and closing points of the contacts to be at or closely adjacent to the subsequent or next zero-crossing of an associated AC load current waveform is beneficial in reducing or preventing arcing and thus contact damage. Although this arrangement is described hereinafter with respect to a so-called 'blow-on/blow-off' contact arrangement, this principle may be applied to single or multiple movable contacts with or without the use of a busbar and/or flexible movable contact arms.

Preferably, the dual-coil actuator includes a magnetically latchable actuator operable by the first drive coil to open and close the movable and fixed electrical contacts. The magnetic latching of an armature of the actuator, in this case being at both an advanced position of a slider extension and a withdrawn position of the slider extension, enables deenergisation of the DC drive coil when at these positions, thus reducing energy consumption.

The second non-drive coil may be feedback connected to a common center connection of the two coils. Such feedback connection of the second non-drive coil preferably provides automatic correction of variation in a drive voltage amplitude applied to the first drive coil, in terms of the dynamic closure time of the contacts.

A busbar is preferably provided in electrical communication with the second terminal and to which an electrically-conductive movable arm is mounted, the at least one movable electrical contact being on or adjacent to the distal end of the movable arm. The busbar is advantageous in providing contra-flowing current relative to the movable arm, whereby a repulsive force can be generated to urge the movable contact into greater contact with the fixed contact.

A further electrically-conductive movable arm may be mounted to the busbar, a further said movable electrical contact being on the further movable arm. This thus allows for current splitting, and as a consequence a reduced heating effect during a short-circuit condition.

In the case of multiple movable arms, also known as blades, the first said movable arm may be preformed and preloaded to be biased towards the said at least one fixed electrical contact in the absence of a separating force, and the said further movable arm may be preformed and preloaded to be biased away from the said at least one fixed electrical contact in the absence of a closing force. This arrangement thus allows for more balanced contact-repulsion forces and blade magnetic forces.

According to a second aspect of the invention, there is provided a method of controlling electrical contact closing and opening delay using an electrical contactor according to the first aspect of the invention, the method comprising the steps of driving a first coil of a dual-coil actuator to open and close electrical contacts of an electrical contactor, and inducing a reverse flux through feedback connection in a second coil to temper and stabilize a net flux in the actuator, thereby controlling a delay time of the opening and closing electrical contacts.

According to a third aspect of the invention, there is provided a method of limiting or preventing electrical contact bounce and arc duration using an electrical contactor according to the first aspect of the invention, the method comprising the steps of driving a first coil of a dual-coil actuator to open and close electrical contacts of an electrical contactor, and inducing a reverse flux through feedback connection in a second coil to temper and stabilize a net flux in the actuator, thereby controlling a delay time of the opening and closing electrical contacts so as to be at or adjacent to a subsequent or next zero-crossing of an associated AC load current waveform.

According to a fourth aspect of the invention, there is provided a method of controlling electrical contact closing and opening delay, the method comprising the steps of driving a first coil of a dual-coil actuator to open and close electrical contacts of an electrical contactor, and inducing a reverse flux through feedback connection in a second coil to temper and stabilize a net flux in the actuator, thereby controlling a delay time of the opening and closing electrical contacts.

According to a fifth aspect of the invention, there is provided a method of limiting or preventing electrical contact bounce and arc duration, the method comprising the steps of driving a first coil of a dual-coil actuator to open and close electrical contacts of an electrical contactor, and inducing a reverse flux through feedback connection in a second coil to temper and stabilize a net flux in the actuator, thereby controlling a delay time of the opening and closing electrical contacts so as to be at or adjacent to a zero-crossing of an associated AC load current waveform.

Preferably, the dual-coil actuator is a DC dual-coil actuator and the first coil is DC driven to open and close the contacts.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
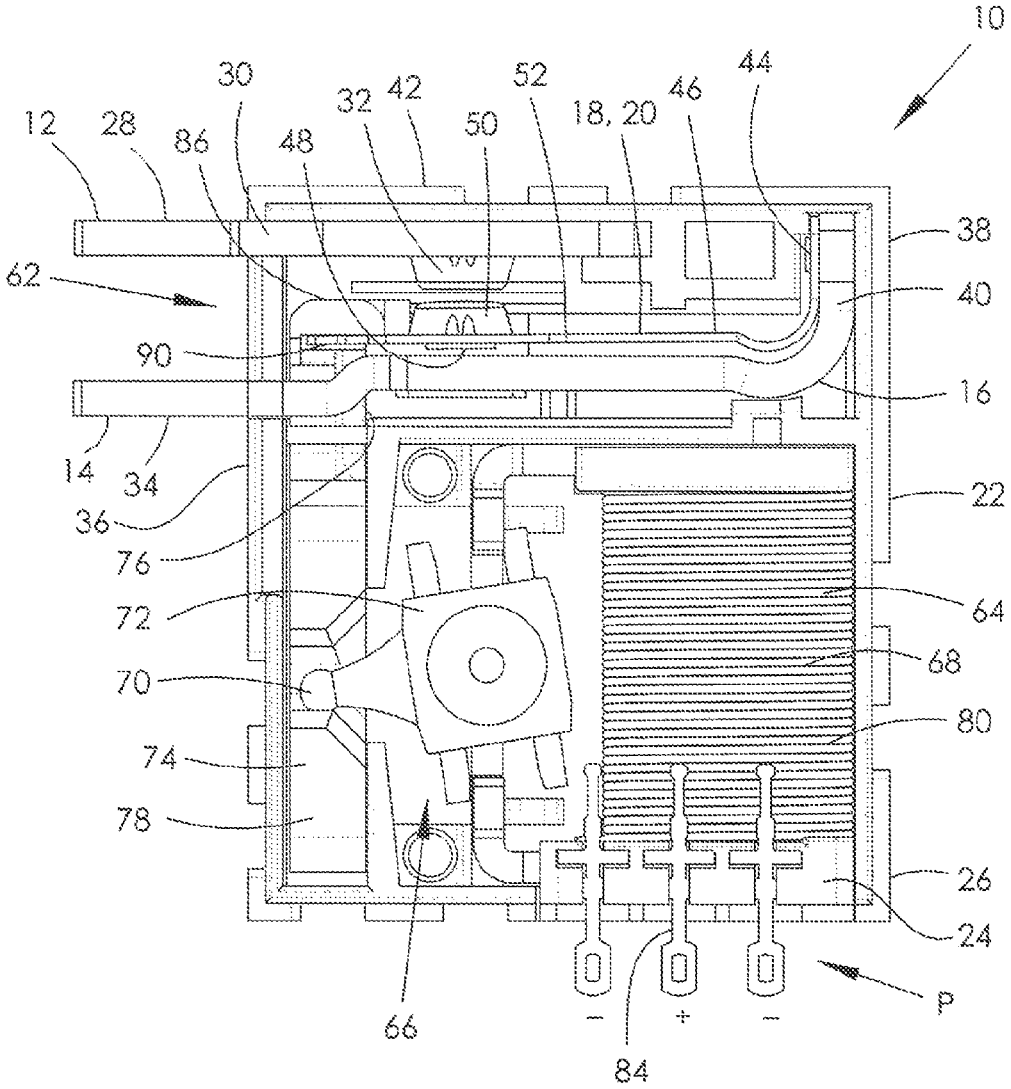
FIG. 1 is a diagrammatic plan view of a first embodiment of an electrical contactor, in accordance with the present invention and utilizing a movable electrical contact set in accordance with the second aspect of the invention, shown in a contacts-open condition.

Referring firstly to FIGS. 1 to 7 of the drawings, there is shown a first embodiment of an electrical contactor, globally shown at 10 and in this case being a single pole device, which comprises first and second terminals 12, 14, preferably a busbar 16, and two movable arms 18, 20 which in this case are mounted to the busbar 16.

The first and second terminals 12, 14 extend from a contactor housing 22, and are mounted to a housing base 24 and/or an upstanding perimeter wall 26 of the contactor housing 22. The housing cover is not shown for clarity.

The first terminal 12 includes a first terminal pad 28 and a fixed, preferably electrically-conductive, member 30 which extends from the first terminal pad 28 into the contactor housing 22. At least one, and in this case two, fixed electrical contacts 32 are provided at or adjacent to a distal end of the fixed member 30. Although two fixed electrical contacts 32 are provided which are spaced apart from each other, it is feasible that a single fixed electrical contact could be provided as a strip accommodating both movable arms 18, 20. However, this would likely increase an amount of contact material required, and thus may not be preferable.

The second terminal 14, which is spaced from the first terminal 12, includes a second terminal pad 34 which extends from the contactor housing 22 and which electrically communicates with the busbar 16.

The busbar 16 is a single rigid elongate monolithic electrically-conductive strip of material, typically being metal, which extends from the second terminal pad 34 at or adjacent one side wall 36 of the contactor housing 22 to an opposing side wall 38 of the contactor housing 22. To further increase a length which facilitates thermal stability in the movable arms 18, 20, the distal tail end portion 40 of the busbar 16 remote from the second terminal pad 34 may be curved to terminate at or adjacent a first end wall 42, along which the fixed member 30 preferably extends.

The two movable arms 18, 20 are engaged with the busbar 16 at or adjacent to its distal tail end portion 40. Engagement may take any suitable form, providing electrical communication is facilitated between the movable arms 18, 20 and the busbar 16. For example, welding, brazing, riveting or even bonding may be utilized.

With reference to FIGS. 1 and 3, the movable arms 18, 20 may comprise a proximal common tail portion 44 which presents a land for engagement with the busbar 16, and elongate body portions 46 which extend in a parallel spaced relationship from the common tail portion 44. The movable arms 18, 20 each terminate with a head portion 48 at which is located a movable electrical contact 50.

The common tail portion 44 of the movable arms 18, 20 is curved towards the first end wall 42 of the contactor housing 22, in order to accommodate the curvature of the distal tail end portion 40 of the busbar 16. The curvature may extend partly to the body portions 46 of the movable arms 18, 20. However, at least a majority of a longitudinal extent of each body portion 46 is preferably straight or rectilinear. Furthermore, it is preferable that the two movable arms 18, 20 are coplanar or substantially coplanar, so that a common or uniform predetermined gap is provided between the movable arms 18, 20 and the busbar 16 as well as between the movable electrical contacts 50 and the fixed electrical contacts 32 in a contacts-open condition.

The elongate body portion 46 of each movable arm 18, 20 defines a repulsive flexible portion 52 between the common tail portion 44 and the head portion 48. The repulsive flexible portion 52 of each movable arm 18, 20 lies in close proximity with a planar body portion 54 of the busbar 16, and may arcuately extend to follow the arcuate distal tail end portion 40.

Although in some instances the movable arms 18, 20 may not necessarily be formed of electrically conductive material, such as copper for example, whereby the movable electrical contacts 50 are fed by or feed separate electrical conductors, such as a wire or cable, in this embodiment it is required that a repulsive force be generatable between the opposing busbar 16 and movable arms 18, 20, and therefore it is preferred that the movable arms 18, 20 are electrically conductive.

It is important that the contacts used have adequate top-lay silver-alloy thickness in order to withstand the arduous switching and carrying duties involved, thus reducing contact wear. Prior art electrical contacts of an 8 mm diameter bi-metal have a silver-alloy top-lay thickness in a range 0.65 mm to 1.0 mm. This results in a considerable silver cost.

To address the issue of tack welding between contacts under high short-circuit loads, a particular compound top-lay can be utilized, in this case enriching the silver alloy matrix with a tungsten-oxide additive. Addition of the tungsten-oxide additive in the top-lay matrix has a number of important effects and advantages, amongst which are that it creates a more homogeneous top-lay structure, puddling the eroding surface more evenly, but not creating as many silver-rich areas, thus limiting or preventing tack-welding. The tungsten-oxide additive raises the general melt-pool temperature at the switching point, which again discourages tack-welding, and due to the tungsten-oxide additive being a reasonable proportion of the total top-lay mass, for a given thickness, its use provides a cost saving.

To assist in damping an opening and closing process of the movable and fixed electrical contacts 32, one of the two movable arms 18, 20 is preformed and preloaded to be naturally biased towards its fixed electrical contact 32, whereas the other of the two movable arms 18, 20 is preformed and preloaded to be naturally biased away from its fixed electrical contact 32.

The biased-closed movable arm 58 is therefore configured to normally or naturally close, for example, with a contact force of 100 gF to 150 gF.

Preferably, the biased-open movable arm 60 must therefore be driven closed, and in this case preferably with an over-travel force of 200 gF to 250 gF.

To control the movable electrical contact set, described above and globally referenced as 62, an actuator arrangement 64 is utilized which comprises in this case a DC driven H-armature rotary motor 66 having a DC dual-coil unit 68. A drive arm 70 of the rotor or armature 72 of the motor 66 controls a slider unit 74 having a linearly-slidable slider extension 76 axially displaceable by the drive arm 70 within a slider housing 78.

Figure 5:
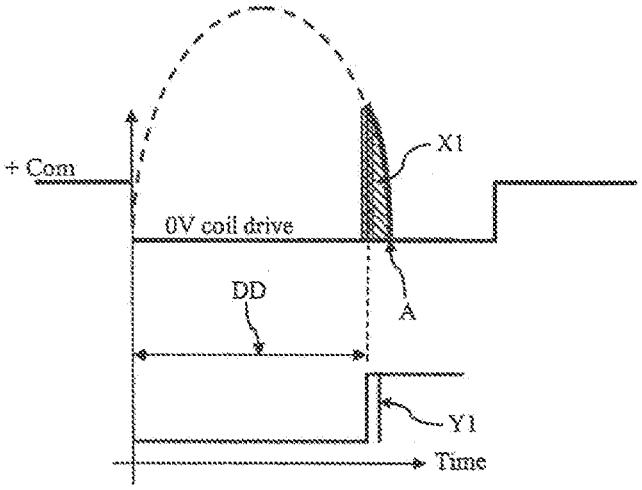
FIG. 5 graphically represents the additional control over the closing of the contacts provided by the electrical contactor.
Figure 7:
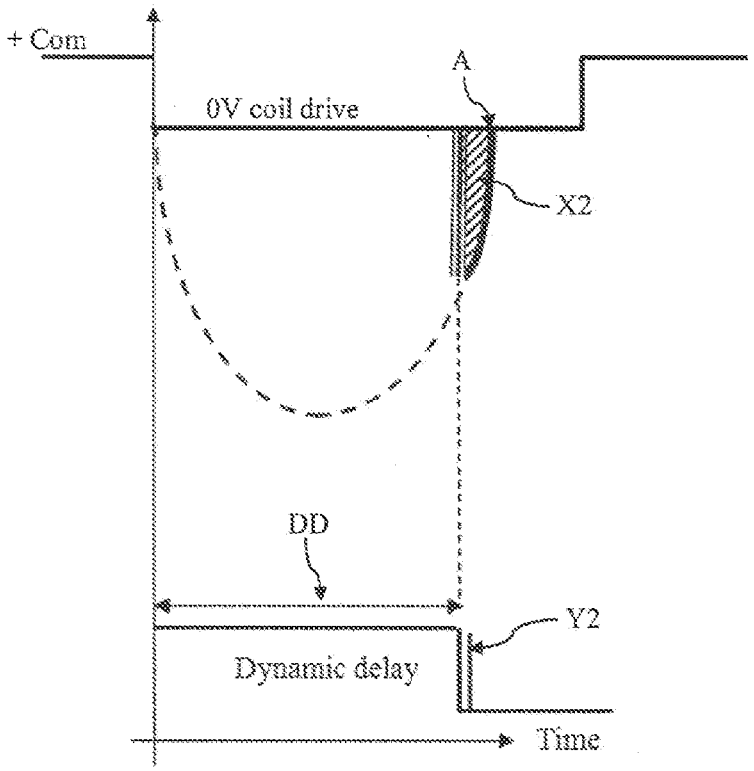
FIG. 7, similar to FIG. 5, graphically represents the additional control over the opening of the contacts provided by the electrical contactor.

In this embodiment, to improve a balance of the opening (release) and closing (operate) processes of the movable and fixed electrical contacts 50, 32, as well as reducing the deleterious effects of arcing and contact bounce, the DC coil drive is synchronized or more closely aligned with an AC load waveform zero-crossing point, referenced as A in FIGS. 5 and 7.

To this end, the actuator arrangement 64 is adapted so that only one coil 80 of the dual-coil unit 68 may be DC pulse driven in one polarity to advance the slider extension 76, and then DC pulse driven with a reversed polarity to withdraw the slider extension 76.

The non-driven or non-energized coil 82 of the dual-coil unit 68 is feedback connected to the original +common center connection 84 of the dual-coil unit 68.

To thereby allow control of the biased-closed and biased-open movable arms 58, 60, the slider extension 76 of the slider unit 74 includes an engagement element 86 and carries an urging device 88. The engagement element 86 in this case may be an overhanging platform which abuts a proximal end portion of the biased-closed movable arm 58, preferably spaced from the associated movable electrical contact 50.

Figure 3A:
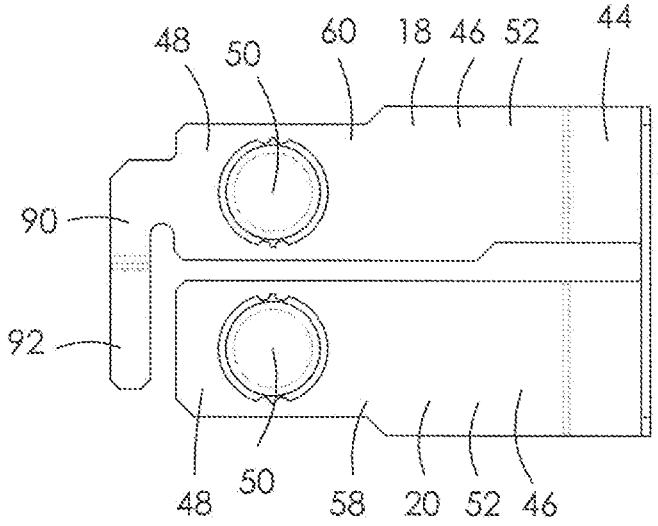
FIG. 3*a* is a plan view of two movable arms of the contact set of the electrical contactor, shown in FIG. 1.
Figure 3B:
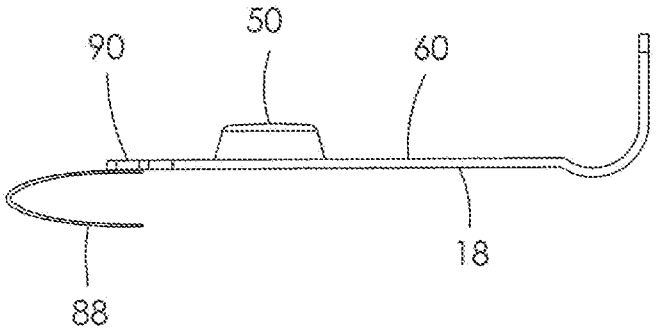
FIG. 3*b* is a side view of a biased-closed movable arm shown in FIG. 3*a*, along with a leaf spring forming an urging device.

The urging device 88 may be a leaf spring, as shown in FIG. 3*b*. To therefore facilitate engagement of the leaf spring 88 with the biased-open movable arm 60, a distal extension element 90, which may be in the form of a tang or tongue, extends from the head portion 48 of the biased-open movable arm 60, proximally of the associated movable electrical contact 50 and towards the slider unit 74. As can be seen in FIG. 3*a*, it is preferable that the distal extension element 90 is an elongate L-shaped member having a free distal end 92 which is at or approaching a plane of the off-side longitudinal edge of the biased-closed movable arm 58.

The leaf spring 88 is mounted on the slider unit 74 or contactor housing 22 so that, when the slider extension 76 is advanced, the leaf spring 88 urges the biased-open movable arm 60 towards its respective fixed electrical contact 32 with the aforementioned over-travel force.

The urging device may take other alternative forms, such as a secondary platform carried by the slider extension 76 which is engagable with an underside of the distal extension element 90 to force the biased-open movable arm 60 into contact with its fixed electrical contact 32, or as a coil spring.

It is feasible that the distal extension element 90 may be dispensed with, if the head portion 48 of the biased-open movable arm 60 can be engaged or controlled in a similar manner to the biased-closed movable arm 58.

To reduce energy consumption associated with the actuator arrangement 64, the rotor or armature 72 may be adapted to magnetically latch at one or both of its rotated positions corresponding to advanced and/or withdrawn states of the slider unit 74.

Figure 2:
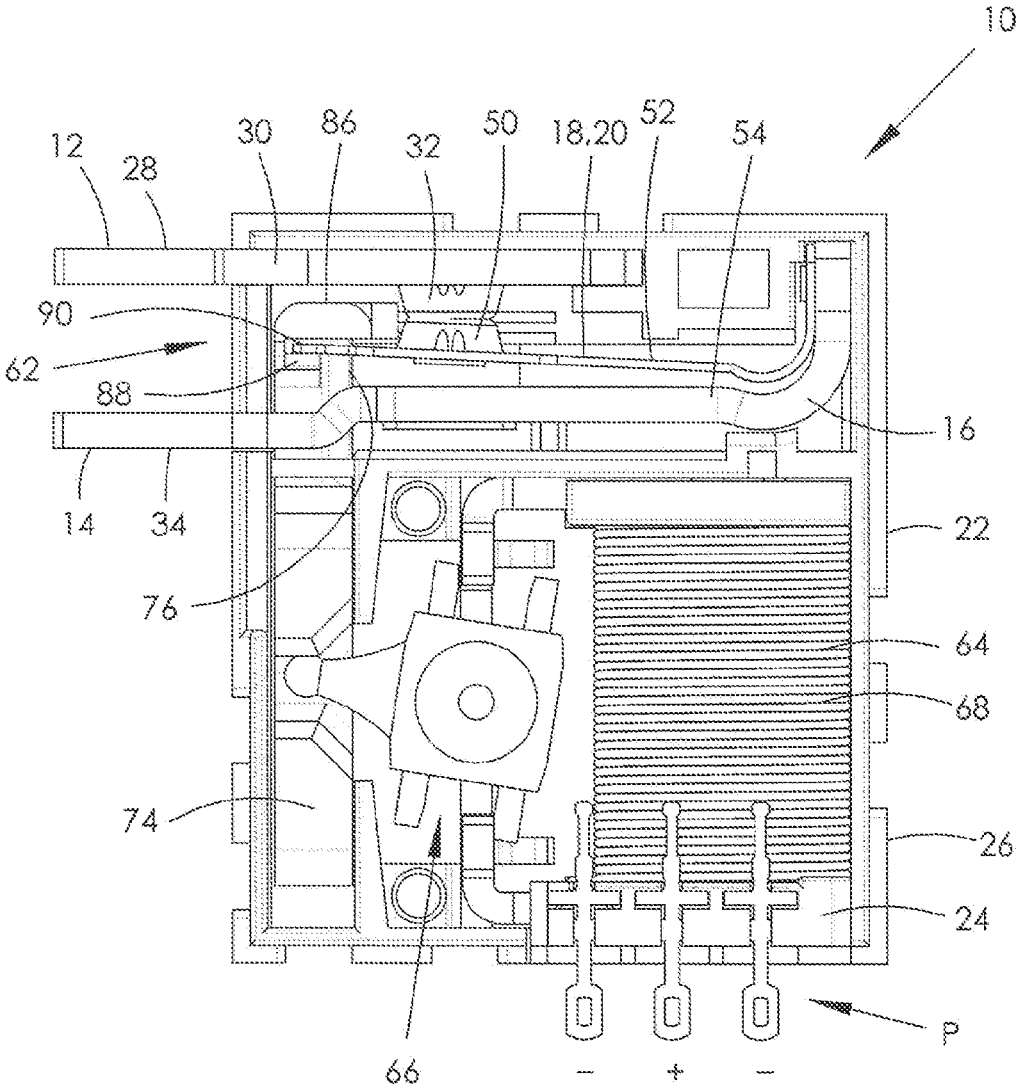
FIG. 2 is a view similar to FIG. 1 of the electrical contactor, shown in a contacts-closed condition.
Figure 4:
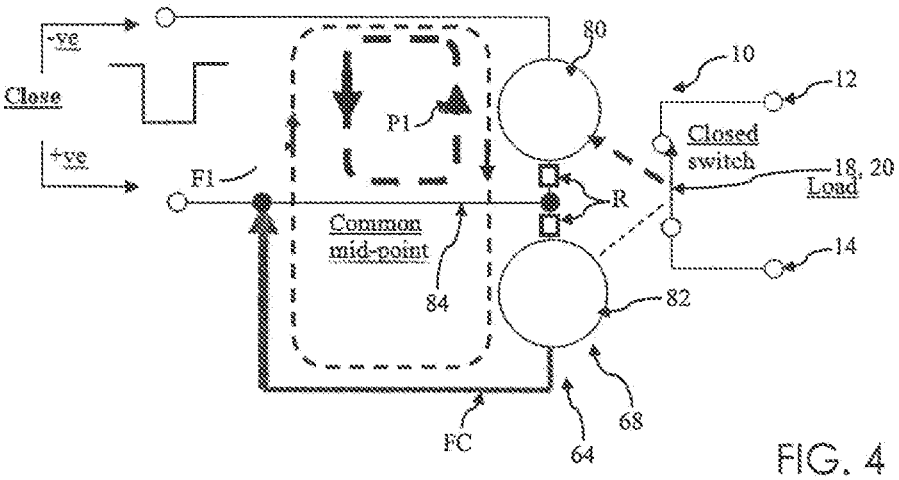
FIG. 4 is a generalized circuit diagram of the electrical contactor, showing an actuator with feedback connection being driven to close the contacts.

In operation, the H-armature rotary motor 66 of the actuator arrangement 64 is driven to rotate the rotor or armature 72 to a first magnetically latched state whereby the slider extension 76 is advanced to its first contacts-closed state, as shown in FIG. 2. As mentioned above, by DC energizing only the drive coil 80 of the dual-coil unit 68 with a first polarity P1 and with the non-driven coil 82 feedback connected, as shown in FIG. 4, a reverse flux F1, can be induced via the feedback connection FC in the non-driven coil 82 thereby tempering and feedback stabilizing a net flux in the DC dual-coil unit 68. This allows the contact closing time DD to be controlled and therefore shifted to or adjacent to the AC load waveform zero-crossing point A, as shown in FIG. 5.

As a consequence, and as can be understood from FIG. 5, by carefully matching the coils, the strength of the feedback connection and flux, and therefore the controlled delay of the closing of the movable and fixed electrical contacts 50, 32, arcing and thus contact erosion energy is reduced or eliminated, shown by hatched portion X1 in FIG. 5, prolonging contact life or improving endurance life. Possible contact bounce, referenced at Y1, is also shifted to or much closer to the subsequent zero-crossing point, referenced at A, again improving contact longevity and robustness during closing.

In the contacts-closed condition, as can be appreciated from FIG. 2, the biased-closed movable arm 58, in the absence of a separating force, naturally closes with its fixed electrical contact 32 with its preloaded biasing force. The biased-open movable arm 60, with the advancement of the slider extension 76, is closed via the leaf spring 88 urging the flexible distal extension element 90.

With the movable arms 18, 20 extending substantially in parallel with the busbar 16, the contra-flowing current produces a repulsive force between the movable arms 18, 20 and the busbar 16 proximally of the movable contacts 50 at the repulsive flexible portions 52. This causes upward bowing of the movable arms 18, 20 away from the busbar 16, thereby augmenting and thus enhancing a closure force at the closed contacts.

At a high shared short-circuit fault current, a significant repulsive magnetic force is generated at the flexible portions 52, causing greater upward bowing and therefore a much higher contact closing force. This repulsive force, due to the flex of the movable arms 18, 20, also potentially causes the movable contacts 50 to tilt relative to the fixed contacts 32, resulting in contact wiping which may be further beneficial in preventing or limiting tack-welding.

With the H-armature rotary motor 66 being DC driven to rotate the rotor or armature 72 to a second magnetically latched state whereby the slider extension 76 is withdrawn to its second contacts-open state, the engagement element 86, being the overhanging platform in this embodiment, picks up the biased flexible distal extension element 90 of the biased-open movable arm 60. As the engagement element 86 counteracts the biasing closed force of the urging device 88, the biased-open movable arm 60 tends to snap open. Simultaneously or fractionally later, the engagement element 86 collects the biased-closed movable arm 58 as the slider extension 76 withdraws, positively breaking the contact engagement between the movable electrical contact 50 of the biased-closed movable arm 58 and its fixed electrical contact 32.

Figure 6:
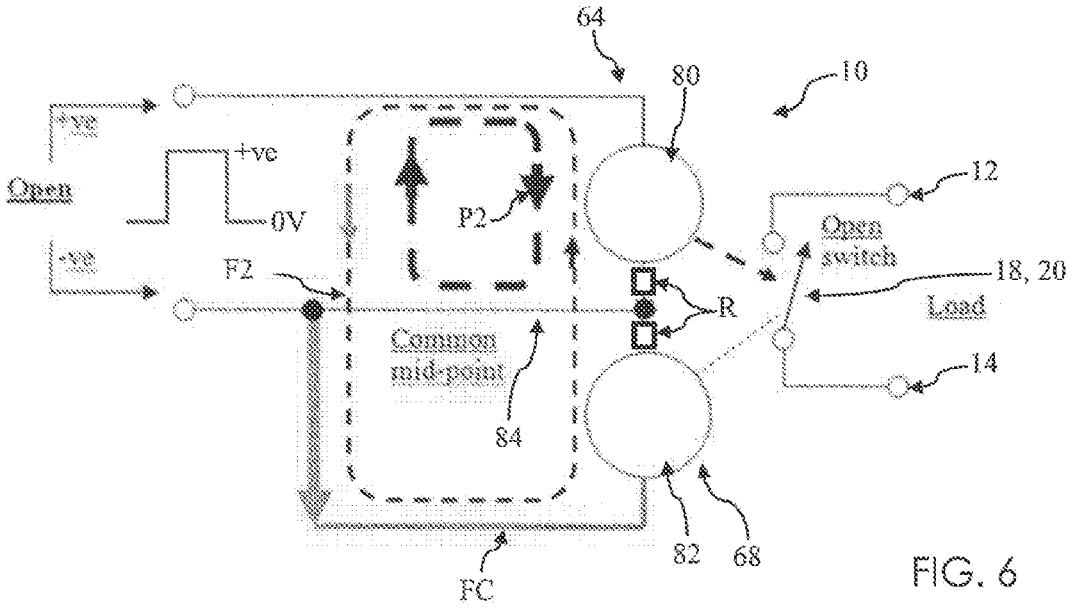
FIG. 6 is a generalized circuit diagram of the electrical contactor, similar to that of FIG. 4 and showing the actuator with feedback connection being driven to open the contacts.

As with the closing or operating process, by reverse driving only the DC drive coil 80 of the dual-coil unit 68 with a reverse polarity P2 and with the non-driven coil 82 feedback connected, as shown in FIG. 6, a reverse flux F2 can be induced via the feedback connection FC in the non-driven coil 82 thereby tempering and feedback stabilizing a net flux in the DC dual-coil unit 68. This allows the contact opening time DD to be controlled and therefore shifted to or adjacent to the AC load waveform zero-crossing point A, as shown in FIG. 7.

Therefore, again and as can be understood from FIG. 7, by carefully matching the coils, the strength of the feedback connection, and therefore the controlled delay of the opening of the movable and fixed electrical contacts 50, 32, arcing and thus contact erosion energy is reduced or eliminated, shown by hatched portion X2 in FIG. 7, prolonging contact life or improving endurance life. Possible contact bounce, referenced at Y2, is also shifted to or much closer to the zero-crossing point A, again improving contact longevity and robustness during opening.

By way of example, a standard or traditional contact opening and closing time may include a dynamic delay of 5 to 6 milliseconds, primarily due to the time taken to delatch the magnetically-retained armature 72. By using the control of the present invention, this dynamic delay is fractionally extended to 7 to 8 milliseconds to coincide more closely or synchronize with the next or subsequent zero-crossing point of the AC load waveform.

Figure 8:
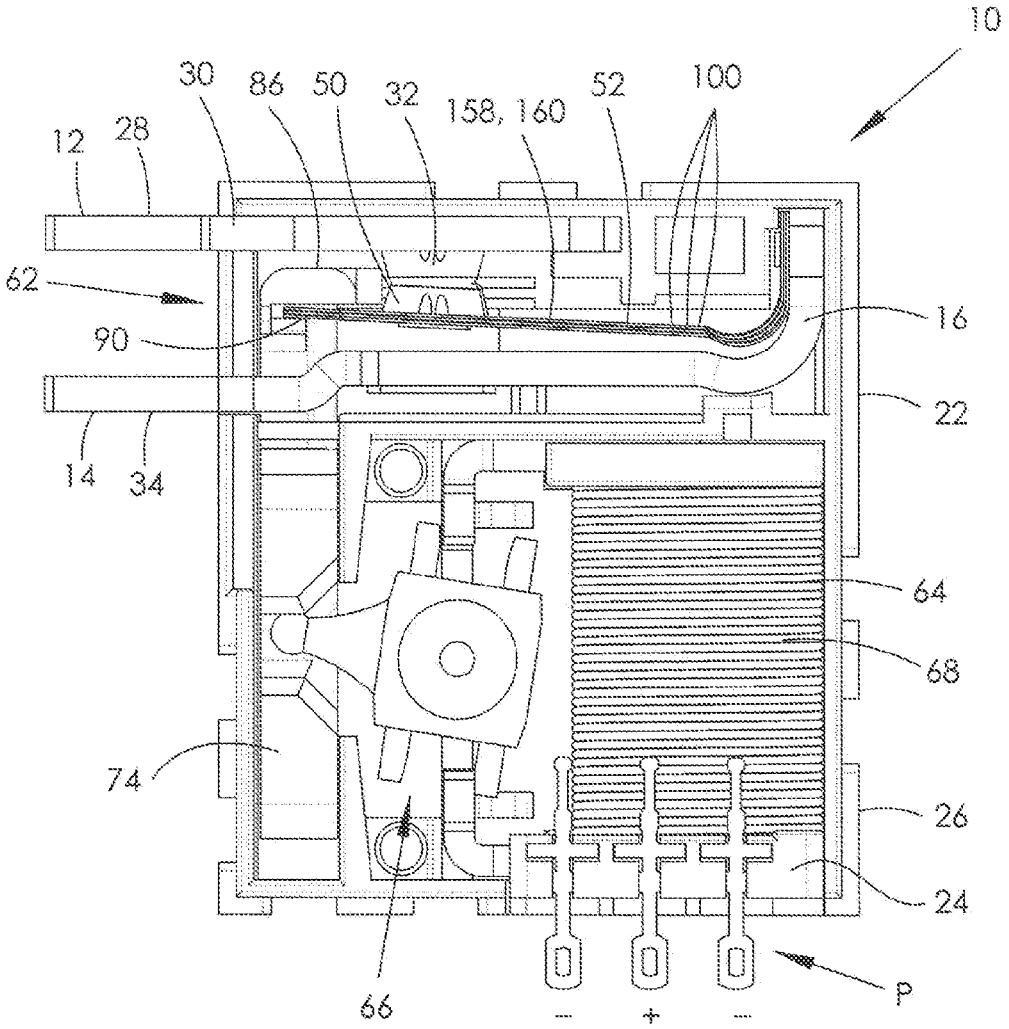
FIG. 8 is a diagrammatic plan view of a second embodiment of an electrical contactor, in accordance with the present invention and utilizing a movable electrical contact set in accordance with the second aspect of the invention, shown in a contacts-closed condition.

Referring to FIG. 8, a second embodiment of an electrical contactor 10 is shown. Similar or identical references refer to parts which are similar or identical to those described above, and therefore further detailed description is omitted.

In this case, the electrical contactor 10 again comprises a movable electrical contact set 62 which includes the busbar 16, biased-open and biased-closed movable arms 158, 160 connected to the busbar 16 and having movable electrical contacts 50 thereon, and the associated fixed electrical contact 32. The movable electrical contact set 62 is provided in the contactor housing 22, with the associated first and second terminals 12, 14 as required.

The American National Standards Institute (ANSI) requirements are particularly demanding for nominal currents up to 120 Amps. The short-circuit current is 10 K.Amp rms, but for a longer withstand duration of four full Load cycles, with 'safe' welding allowable.

The single-thickness push-pull multiple arms or blades 18, 20 of the first embodiment are sufficient such that, during a short-circuit load condition of only half-cycle duration, thermal parameters of the shared split movable contact arms 18, 20 are adequate, thereby showing no excessive heating and not losing spring characteristics.

The ANSI short-circuit withstand duration is four full Load cycles, thereby being eight times longer than that of the IEC requirement at only half-cycle. The extra $I^2R$ heat generated has to be accommodated to ensure that the thermal parameters are adequate with no excessive heating or loss of spring characteristic, whilst still being drivable by the actuator arrangement 64.

Each movable arm 158, 160 therefore includes at least two electrically-conductive overlying layers 100, thereby effectively forming a laminated movable arm. In this embodiment, three overlying layers 100 are provided, but more than three layers can be envisaged. The layers 100 are preferably of the same electrically-conductive material, typically being metal, such as copper, but may be of different electrically-conductive materials.

At least one, and preferably all, of the superposed layers 100 are preferably thinner than the single layer movable arms 18, 20 of the first embodiment. Consequently, whilst the overall thickness of the laminated movable arm 158, 160 of the second embodiment may be greater than the thickness of the unlaminated movable arm 18, 20 of the first embodiment, thereby accommodating a greater heating effect, a flexure force can be decreased. In general terms, a double lamination will halve a flexure force, and a triple lamination will reduce the flexure force by around two thirds.

Longitudinal and lateral extents of the groups of overlying layers 100 are preferably matched or substantially matched. The layers 100 extend from their common tail portions 44 at which they are interconnected, for example, by riveting, brazing or welding, to the head portions 48. Advantageously, the respective movable electrical contacts 50 may interengage the respective head portions 48 of the associated overlying layers 100.

It is beneficial for heat dissipation that the overlying layers 100 may not be further interconnected along their longitudinal extents. However, additional interconnection such as by riveting can be accommodated, if required.

The above embodiments benefit from the actuator arrangement 64 which utilizes only one DC drive coil 80 energized in two polarities to advance and withdraw the slider extension 76 along with the feedback connected non-driven coil 82. However, benefits can still be obtained by utilizing the DC dual-coil unit 68 in which one coil is, preferably negatively, DC driven to advance the slider extension 76 whilst the other coil is, preferably negatively, DC driven to retract the slider extension 76. In this regard, the DC dual-coil unit 68 is driven via a series resistor R to the positive common midpoint.

Although the above embodiments are described with respect to a split movable contact arm, thereby presenting twin parallel arms or blades, the actuator arrangement which utilizes only one DC drive coil driven in two polarities to advance and withdraw the slider extension along with the feedback connected non-driven coil to control a dynamic delay of the opening and closing contacts can be applied to a single monolithic movable contact arm or single laminated movable contact arm with a plurality of layers as described above.

Furthermore, although a split movable contact arm having a single biased-closed movable arm and a single biased-open movable arm is suggested, more than one biased-closed movable arm and more than on biased-open movable arm may be provided.

Additionally or alternatively, although the actuator arrangement described above is preferably a H-armature rotary motor, any other suitable actuator can be utilized. For example, a double-magnet-latching electromagnetic actuator could certainly be utilized.

It is thus possible to provide an electrical contactor which utilizes a biased-closed movable contact arm and a biased-open movable contact arm to balance and reduce a drive burden of an actuator. A more balanced and efficient 'push-pull' multi-blade device is thus provided with a 'snatch-assisted' open translation. The DC dual-coil unit can also be minimized in terms of wire, typically copper, turns and thus cost.

It is also possible to reduce self-heating due to the multiple arms or blades. For example, at 100 Amps, with a twin arm or blade device, each arm or blade will be carrying 50 Amps. By utilizing laminations, this heating effect is still further mitigated. Contact welding at the higher moderate and dead-short fault currents is therefore prevented.

By use of the fixed busbar, the switching currents flow in the same direction in the side-by-side movable arms, thus maximizing a magnetic repulsion force between the arms across the working gap to the adjacent busbar carrying the contra-flowing total load current. Especially at very high current, the contacts are thus maintained tightly closed using this so-called blow-on technique.

Since the load side contact-switching, connect-ON and disconnect-OFF functions may take place in the context of, for example, a 230 V AC supply at nominal current of 100 Amps, if the AC 0V/Neutral coil drive is not synchronized with the load AC waveform, the contact closing and opening points will be somewhat random, and may occur often before or at the voltage peak. This can cause considerably longer arcing, more contact erosion damage, and reduced endurance life. To mitigate this problem, it is thus also possible to provide an electrical contactor with a DC dual-coil drive which utilizes only one DC drive coil driven in two polarities to close and open the electrical contacts along with a feedback connected non-driven coil controlling a dynamic delay of the opening and closing contacts. Although a DC dual-coil drive unit having a DC drive coil is described above, it is feasible that the dual-coil unit may be AC supplied and thus the drive coil is an AC drive coil.

The words 'comprises/comprising' and the words 'having/including' when used herein with reference to the present invention are used to specify the presence of stated features, integers, steps or components, but do not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The embodiments described above are provided by way of examples only, and various other modifications will be apparent to persons skilled in the field without departing from the scope of the invention as defined by the appended claims.

The invention claimed is:

1. An electrical contactor comprising:

a first terminal having a fixed member with at least one fixed electrical contact;

a second terminal;

at least one movable electrical contact in electrical communication with the second terminal;

a dual-coil actuator having a first drive coil drivable to open and close the movable and fixed electrical contacts, and a second non-drive coil feedback connected to induce a reverse flux to temper and stabilize a net flux, thereby enabling control of a delay time of the opening and closing electrical contacts so as to be at or adjacent to a zero-crossing of an associated AC load current waveform;

a busbar in electrical communication with the second terminal and to which an electrically-conductive movable arm is mounted at or adjacent to a distal end thereof, the at least one movable electrical contact being on the movable arm, wherein a further electrically-conductive movable arm is mounted to the busbar, a further said movable electrical contact being on the further movable arm, and wherein the first said movable arm is preformed and preloaded to be biased towards the said at least one fixed electrical contact in the absence of a separating force, and the said further movable arm is preformed and preloaded to be biased away from the said at least one fixed electrical contact in the absence of a closing force.

* * * * *